US008590244B2

(12) United States Patent
O'Riordan

(10) Patent No.: US 8,590,244 B2
(45) Date of Patent: Nov. 26, 2013

(54) GARAGE DOOR INSULATION SYSTEM

(75) Inventor: Brian P. O'Riordan, Ashville, OH (US)

(73) Assignee: Owens Corning Intellectual Capital, LLC, Toledo, OH (US)

( * ) Notice: Subject to any disclaimer, the term of this patent is extended or adjusted under 35 U.S.C. 154(b) by 379 days.

(21) Appl. No.: 12/363,798

(22) Filed: Feb. 2, 2009

(65) Prior Publication Data

US 2009/0199501 A1 Aug. 13, 2009

Related U.S. Application Data

(60) Provisional application No. 61/026,906, filed on Feb. 7, 2008.

(51) Int. Cl.
*E04B 1/74* (2006.01)

(52) U.S. Cl.
USPC ..... 52/407.4; 52/506.05; 52/127.11; 52/404.2; 52/506.07; 52/718.02; 52/712; 411/509; 411/338; 160/229.1; 160/232

(58) Field of Classification Search
USPC ..... 52/455, 784.15, 784.1, 71, 127.11, 52/309.5, 407.4, 506.07, 718.07, 712; 160/229.1, 201, 232, 405, 408, 506.05, 160/741.4, 745.21, 547, 582.1, 506.01, 133, 160/236, 235; 411/338, 508, 510
See application file for complete search history.

(56) References Cited

U.S. PATENT DOCUMENTS 3,750,333 A * 8/1973 Vance ..... 49/501
4,119,133 A 10/1978 Wolf
4,175,728 A * 11/1979 Ferguson ..... 269/91
4,379,480 A * 4/1983 Kempel et al. ..... 160/232
4,436,136 A 3/1984 Downey, Jr.
4,441,301 A * 4/1984 Benson ..... 52/784.13
4,558,916 A * 12/1985 Hehl ..... 439/467
4,572,694 A * 2/1986 Hoeksema ..... 403/187
4,576,532 A * 3/1986 Hanson et al. ..... 411/352
4,630,664 A 12/1986 Magro
4,693,630 A * 9/1987 Giovannetti ..... 403/231
4,736,563 A * 4/1988 Bilhorn ..... 52/460
4,776,557 A * 10/1988 Turner ..... 249/196
4,840,523 A * 6/1989 Oshida ..... 411/48

(Continued)

FOREIGN PATENT DOCUMENTS

AU 2004100232 4/2004
AU 2007216143 3/2008

(Continued)

OTHER PUBLICATIONS www.garagedoorsupply.com, *Garage Door Parts*, LLC, Jan. 22, 2008.

(Continued)

*Primary Examiner* — Chi Q Nguyen
(74) *Attorney, Agent, or Firm* — Calfee, Halter & Griswold LLP

(57) ABSTRACT

An insulation system includes a panel having a major surface, a layer of fibrous insulating material and at least one securing clip affixed to the panel and securing the insulation layer to the major surface. Each clip includes first and second connectors. Each connector includes a head, two diametrically-opposed resilient latching elements projecting from the head and a first locking shoulder extending at least partially between the latching elements. Each latching element includes a latching shoulder adjacent a distal end opposite the head.

22 Claims, 6 Drawing Sheets

(56) References Cited

U.S. PATENT DOCUMENTS

| | | | | |
|---|---|---|---|---|
| 5,016,700 | A * | 5/1991 | Wegner et al. | 160/232 |
| 5,176,465 | A | 1/1993 | Holsted | |
| 5,419,386 | A | 5/1995 | Magro et al. | |
| 5,564,164 | A * | 10/1996 | Jella | 16/355 |
| 5,617,687 | A * | 4/1997 | Bussey et al. | 52/404.2 |
| 5,709,259 | A * | 1/1998 | Lewis et al. | 160/201 |
| 5,775,860 | A * | 7/1998 | Meyer | 411/46 |
| 5,787,677 | A | 8/1998 | Bolich et al. | |
| 5,857,510 | A | 1/1999 | Krupke et al. | |
| 5,943,803 | A | 8/1999 | Zinbarg | |
| 6,035,919 | A | 3/2000 | Zinbarg | |
| 6,119,878 | A * | 9/2000 | Zen | 211/94.01 |
| 6,131,345 | A | 10/2000 | Pelusio | |
| 6,148,569 | A * | 11/2000 | Giovannetti | 52/127.11 |
| 6,148,896 | A | 11/2000 | Pinto et al. | |
| 6,551,677 | B2 * | 4/2003 | Weinstein et al. | 428/43 |
| 6,679,310 | B2 | 1/2004 | De Zen | |
| 6,725,898 | B2 | 4/2004 | Mullet et al. | |
| 6,772,818 | B2 | 8/2004 | Whitley et al. | |
| 6,908,252 | B1 * | 6/2005 | Rubano | 403/231 |
| 6,915,573 | B2 | 7/2005 | Mullet et al. | |
| 7,134,471 | B2 * | 11/2006 | Bennett et al. | 160/201 |
| 7,431,068 | B1 * | 10/2008 | Jella | 160/236 |
| 7,584,582 | B1 * | 9/2009 | Hutter, III | 52/506.02 |
| 2003/0005656 | A1 | 1/2003 | Kim et al. | |
| 2005/0016694 | A1 | 1/2005 | Jella | |
| 2005/0050824 | A1 | 3/2005 | Warner, III | |
| 2005/0076591 | A1 | 4/2005 | Koeller | |
| 2006/0154115 | A1 | 7/2006 | Fellinger et al. | |
| 2006/0254730 | A1 | 11/2006 | Wood | |
| 2007/0062136 | A1 | 3/2007 | Kim et al. | |
| 2007/0068101 | A1 * | 3/2007 | Weir et al. | 52/302.1 |
| 2007/0215295 | A1 | 9/2007 | Hormann et al. | |

FOREIGN PATENT DOCUMENTS

| | | |
|---|---|---|
| DE | 29721519 | 3/1998 |
| DE | 19754046 | 2/1999 |
| EP | 319687 | 6/1989 |
| FR | 2772825 | 6/1999 |
| FR | 2861365 | 4/2005 |

OTHER PUBLICATIONS www.homedepot.ca, *Garage Door Insulation Blanket Kit*, Jan. 22, 2008.

www.texasgarages.com/insulation.htm, "*Garage Door Insulation Products*", "*Reflective Foil Garage Door Insulation Kits*", "*Reflective Foil Installation Instructions*" Jan. 22, 2008.

* cited by examiner

GARAGE DOOR INSULATION SYSTEM

This application claims the benefit of Provisional Patent Application Ser. No. 61/026,906, filed on 7 Feb. 2008.

BACKGROUND OF THE INVENTION

1. Field of the Invention

This invention relates in general to insulation products, and more specifically to an insulation product particularly suited for use in conjunction with a garage door.

2. Discussion of the Prior Art

A garage for a vehicle includes a garage door for entrance and exit of the vehicle. The garage door is a large rectangular door which usually includes an upper panel, a lower panel, and two center panels. The panels are connected to one another by hinges. A typical panel includes a frame along its upper and lower edges. The panel further includes a door tray inside the frame which defines a major surface. The door tray is recessed from the frame and it is generally flat, with the exception that a contour is formed in the door tray. The contour forms raised areas in the door tray. The garage door can be opened by sliding it upward on a pair of rails extending along the opening and ceiling of the garage.

A garage door is often provided with insulating material to provide thermal insulation and to attempt to dampen the sound. One type of conventional insulation for garage doors is plastic foam (polyethyelene or polystyrene) insulation. The insulation is secured to the interior of each door panel. The surface of a door panel is often contoured to produce an attractive design. Unfortunately, the plastic foam insulation is formed in relatively rigid sheets that are not adapted for the contours of a door panel.

One way to address this problem is to mold the plastic foam insulation to include recesses adapted to receive the contours of the door panel. Unfortunately, the molding process adds an extra step to the manufacture of the insulation so that it is more expensive to produce.

Other insulation systems for garage doors include a fibrous or other insulation material with a facing on one or both sides of the insulation layer. Installing the insulation includes friction fitting the edges of the insulation into the contours of the door trays of the garage door frame. If the insulation is not adhered to the garage door by means of an adhesive, the insulation is prone to falling out of the door or sagging.

Another insulation system includes an insulation having a facing including an adhesive on a substantial portion of the side of the insulation that is adjacent to the garage door. However, affixing the insulation to the door by means of an adhesive has proven to be very difficult and time consuming. It is difficult to control where the insulation will affix to the door and may not be removed or reinstalled easily if there is an error as to the placement of the insulation on the door.

Another alternative to adhering the insulation to the door includes taping the insulation to the edges of the door. However, over time, the tape becomes loose and the insulation is prone to falling off of the door.

In the past, there have been several garage door insulating "kits" in the market place. The majority of these kits—are made up of large pieces of foam board panels, which are bulky. Additionally, foam board panels have proven to be extremely difficult to install because of their rigidity. Further, they are extremely difficult to fit in a store display and to transport in an automobile.

Thus, it would be desirable to provide a garage door insulation system which overcomes the shortcomings of the conventional insulated garage door and provides a simple, convenient solution to consumers in the marketplace.

SUMMARY OF THE INVENTION

The insulation system of the present invention includes a panel having a major surface, a layer of insulating material and at least one securing clip affixed to the panel securing the insulation layer to the major surface.

According to this invention there is also provided a method of installing an insulation layer on a panel. The method includes the steps of (a) affixing at least one clip to a major surface of the panel, (b) positioning a portion of insulation material over a first connector of that clip so that the first connector extends through the insulation material and (c) connecting a second connector of that clip to the first connector so as to secure the insulation material to the panel.

In accordance with yet another aspect of the present invention a method is provided for installing an insulation layer on a garage door where that garage door includes a plurality of panels. The method includes the step of affixing at least one clip to a major surface of a first panel of the plurality of panels. The method further includes the step of positioning a first section of the insulation material over a first connector of that clip so that the first connector extends through the first section of the insulation material. In addition, the method includes connecting a second connector of that clip to the first connector so as to secure the first section of insulation material to the first panel. Additional sections of insulation material are mounted to additional panels of the plurality of panels in the same manner the first section of insulation material is mounted to the first panel.

According to this invention there is also provided a garage door insulating kit. The kit includes at least eight sections of insulation material and at least sixteen clips.

According to yet another aspect of this invention, there is provided a connector. The connector includes a head. Two diametrically-opposed resilient latching elements project from that head. In addition, a first locking shoulder extends at least partially between the latching elements. Further, at least one latching element of the two diametrically-opposed latching elements includes a latching shoulder adjacent a distal end opposite the head.

Additional objects, features and advantages of the present invention will become more readily apparent from the following detailed description of preferred embodiments when taken in conjunction with the drawings wherein like reference numerals refer to corresponding parts in the several views.

BRIEF DESCRIPTION OF THE DRAWINGS

The accompanying drawings incorporated herein and forming a part of the specification, illustrate several aspects of the present invention and together with the description serve to explain certain principles of the invention. In the drawings.

DETAILED DESCRIPTION

Figure 1:
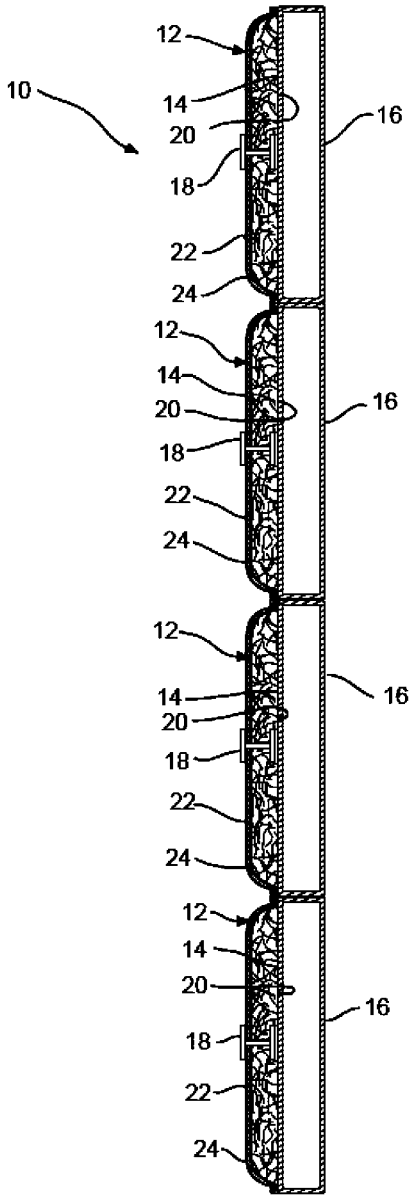
FIG. 1 is a cross-sectional view of a garage door including the insulation system of the present invention.

Reference is now made to FIG. 1 generally illustrating the insulation system 10 of the present invention. The insulation system 10 comprises a layer of insulation material 12 that is affixed to a major external surface 14 of a panel 16 by at least one securing clip 18. Four securing clips 18 are illustrated in FIG. 1. It should be appreciated, however, that substantially any number of securing clips 18 may be utilized as suited for any particular application.

As illustrated in FIG. 1, the insulation material 12 includes a first side 20 and a second side 22. The first side 20 of the insulation material 12 is provided adjacent to the major exterior surface 14 of the panel 16. An optional facing 24 may be provided on the second side 22 of the insulation material 12. When properly mounted, each securing clip 18 extends through the insulation material 12 and the optional facing 24, if it is present. The facing 24 may be made from any suitable facing material including, but not limited to, polymers, such as vinyl, nylon or polyester, polymer films, paper, foil, cloth, woven or non-woven fabric or combinations thereof.

The insulation material 12 may be any insulation material known, including but not limited to, fiberglass insulation batting, mineral wool, polymer fibers, foams, blown-in foams, flexible foams, natural fibers and combinations thereof. In one embodiment, the insulation material 12 may have an R-value of between about 2 to about 100, or about 2 to about 50, or about 2 to about 40, or about 2 to about 30, or about 2 to about 20, or about 2 to about 10. The panel 16 may be any panel including, but not limited to, walls, doors and garage doors. The insulation system may also be used on industrial doors, delivery trucks, trailers, sheds, pet enclosures, metal buildings, ice shanties, hunting blinds, campers, boats or any other structure having panels where insulation may be necessary. Such panels 16 may be constructed from substantially any appropriate material including, but not limited to, polymer materials, wood, metal, steel, fiberglass composite materials and the like.

Figure 2:
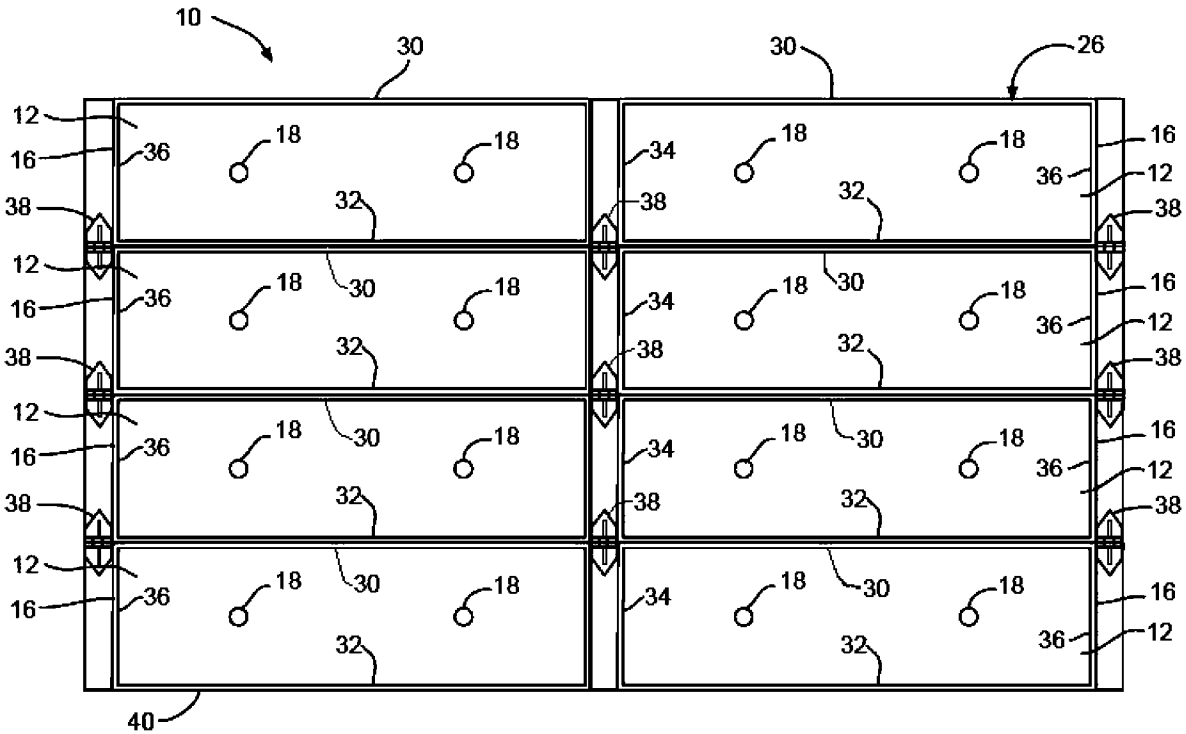
FIG. 2 is rear (a.k.a interior) view of a garage door including the insulation system of the present invention.

As illustrated in FIG. 2, the insulation system 10 of the present invention is particularly useful on a garage door 26. The illustrated garage door 26 includes four rows of panels 16. Two panels 16 are provided in each row. The height of the garage door 26 is determined by the number of panels 16 used and is equivalent to the height of the garage entry opening. The width of the rows of panels 16 is equivalent to the width of the garage entry opening so that the height and width of the garage door is equivalent to the height and width of the garage entry opening. A first frame member 30 is provided at the top of each panel 16. Similarly, a second frame member 32 is provided at the bottom of each panel 16. The four rows of panels 16 are joined together at the mid section by third frame members 34. Similar fourth frame members 36 are provided at the ends of the panel rows and define the left and right margins of the garage door 26. A series of hinges 38 connect the adjacent frame members 34, 36. These hinges 38 allow the garage door 26 to fold during opening and closing. Typically a sealing member 40 is provided at the bottom of the garage door 26 to seal between the garage door 26 and an underlying concrete pad (not shown).

Figure 2A:
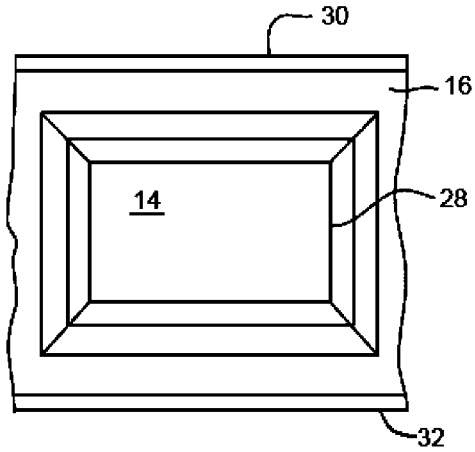
FIG. 2A is a detailed view of one possible embodiment of the garage door panel incorporating a raised contour in the doorway.

As illustrated in FIG. 2A one or more of the panels 16 may have a major exterior surface 14 that is contoured. Thus, the panel 16 carries a first frame member 30 and a second frame member 32. The major exterior surface 14 includes a panel tray 28 comprising a raised contour. Typically the layer of insulation material 12 is sufficiently resilient and compressible to accommodate the raised contour of the panel tray 28. However, it should be appreciated that the layer of insulation material 12 may alternatively, be manufactured to include a cavity to accommodate the panel tray 28 if desired.

Figure 4:
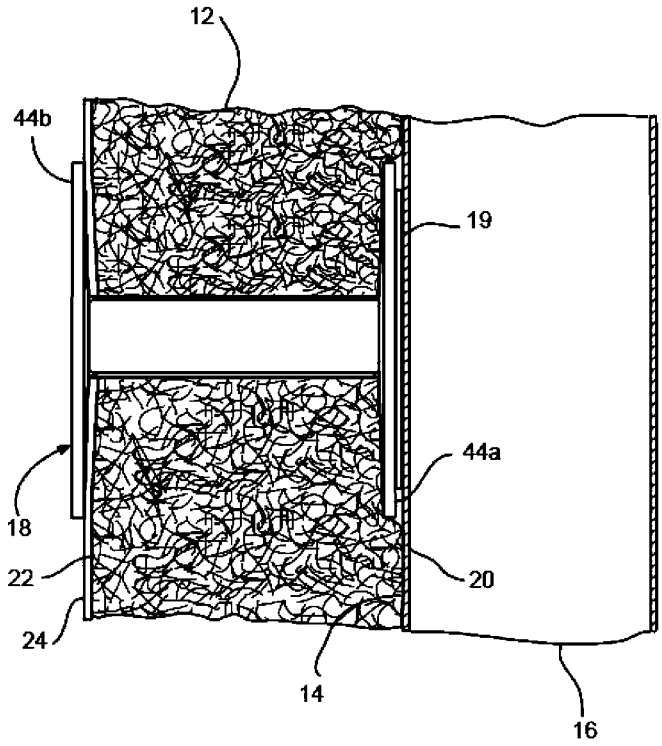
FIG. 4 is a side elevational view showing two cooperating clips used to secure a blanket of insulation material to a panel of a garage door.

As best illustrated in FIGS. 2 and 4, at least one clip, generally designated by reference numeral 18 is utilized to secure the layer of insulation material 12 to the major exterior surface 14 of each panel 16. In the illustrated embodiment, each clip 18 is affixed to the panel 16 with an adhesive 19 such as a pressure sensitive adhesive as manufactured by MACtae of Stow, Ohio. In the embodiment illustrated in FIG. 2, two clips 18 are provided to secure each layer of insulation 12 to each panel 16.

Figure 3:
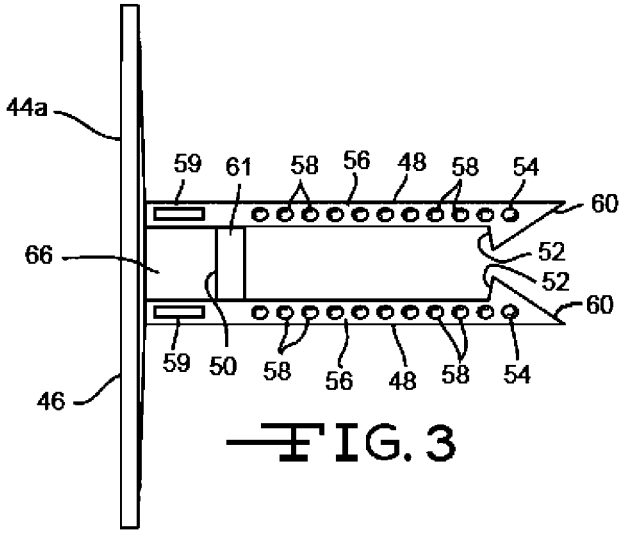
FIG. 3 is a side elevational view of a securing clip of the present invention.
Figure 5:
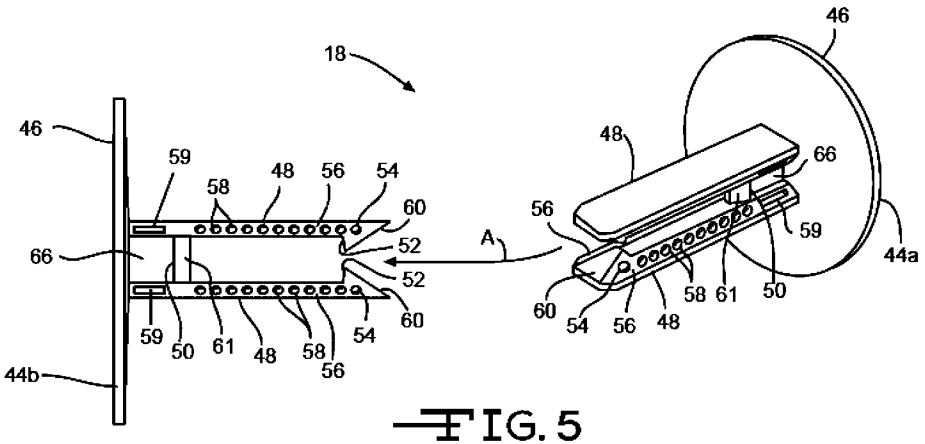
FIG. 5 is a cross section of the clip with the two connectors fully seated, taken along line 55 of FIG. 4.

As best illustrated in FIGS. 3 and 5, each clip 18 comprises first and second connectors 44*a* and 44*b*. In the illustrated embodiment the first and second connectors 44*a* and 44*b* are identical. As best illustrated in FIG. 3, each of the connectors 44*a* and 44*b* includes a head 46. In the illustrated embodiment the head 46 is enlarged and disc shaped. Two diametrically opposed resilient latching elements 48 project from the head 46. A first locking shoulder 50 extends at least partially between the latching elements 48. A second locking shoulder (not shown) is provided opposite the first locking shoulder 50. At least one latching element 48 of the two diametrically-opposed resilient latching elements 48 includes a latching shoulder 52 adjacent a distal end opposite the head 46 (two latching shoulders 52 are illustrated in FIG. 3).

As further illustrated in FIGS. 3 and 5, the latching elements 48 include beveled side walls 56 and a pair of opposed, projecting detents 54 adjacent the distal end. In addition a series of aligned notches 58 are provided in the beveled side walls 56. The last of the notches 59 is elongated to allow for full seating of the connectors 44*a* and 44*b*. Further, opposing first cam surfaces 60 are provided adjacent the latching shoulders 52 and the distal end of the connectors 44*a* and 44*b* and opposing second cam surfaces 61 are provided adjacent the locking shoulders 50.

First and second connectors 44*a* and 44*b* are interconnected as illustrated in FIG. 5 by rotating one of the connectors 44 through 90° so that the latching elements 48 of the two connectors 44*a* and 44*b* are 90° out of phase. The two connectors 44*a* and 44*b* are then pushed together (note action arrows A in FIG. 5). When fully seated, the first and second latching shoulders 52 of the first connector 44*a* engage the opposed first locking shoulders 50 of the second connector 44*b*. The cooperating first and second cam surfaces 60 and 61 allow for smooth interconnection. As the connectors 44*a* and 44*b* are pushed together, the projecting detents 54 of the first connector 44*a* engage in the notches 58 of the second connector 44*b* to provide a sensory signal to the user that the connectors 44*a* and 44*b* are properly aligned and moving toward complete connection. The final click that signals full seating occurs when the latching shoulders 52 snap into cavities 66 of the second connector 44*b* and engage with the cooperating locking shoulders 50. It should be appreciated that the detents 54 of the connector 44*b* engage in the notches 58 of the connector 44*a* and the latching shoulders 52 of the connector 44*b* engage the locking shoulders 50 of the connector 44*a* at the opposite end of the clip 18 when the connectors 44*a* and 44*b* are fully seated. The resilient nature of the latching elements 48 ensures the positive connection. The enlarged head 46 engages a significant surface area of the insulation material 12 or optional facing 24 so as to prevent the insulation material from pulling off the connector 18 under the pull of gravity and during operation of the garage door 26.

The method of installing a layer of insulation material 12 on a panel 16 will now be described in detail with reference to FIG. 4. The method includes affixing at least one connector 44*a* to a major exterior surface 14 of a panel 16. More specifically, the first connector 44*a* of the clip 18 may be affixed to the major exterior surface 14 by means of an adhesive 19 such as a pressure sensitive adhesive. This is followed by the positioning of a portion or section of insulation material 12 over the first connector 44*a* so that the first connector 44*a* extends through the insulation material 12. It should be noted that the insulation material 12 may be cut or slit at the point of insertion so as to more easily permit the connector 44*a* to extend through the insulation material 12. When the layer of insulation material 12 is properly seated on the connector 44*a*, the first side 20 of the insulation material 12 abuts the major exterior surface 14 of the panel 16. Further, the distal end of the connector 44*a* extends through the optional facing 24 on the second side 22 if that facing 24 is present.

As shown in FIG. 2, two clips 18 may be installed to secure each insulation layer 12 to each panel 16 of a garage door 26. Of course, it should be noted that fewer or more clips may be used depending on the size of the panel 16 and the size and/or weight of the insulation layer 12. Further, depending on the application, the insulation layer 12 may be one large piece or several smaller pieces. As illustrated in FIG. 2, a garage door 26 includes eight panels 16 with each panel 16 being covered by a single layer and section of insulation material 12 and each layer of insulation material being held in place by two clips 18. Of course, it should also be appreciated that more than one layer of insulation may be attached to the panels 16 if desired.

Figure 6:
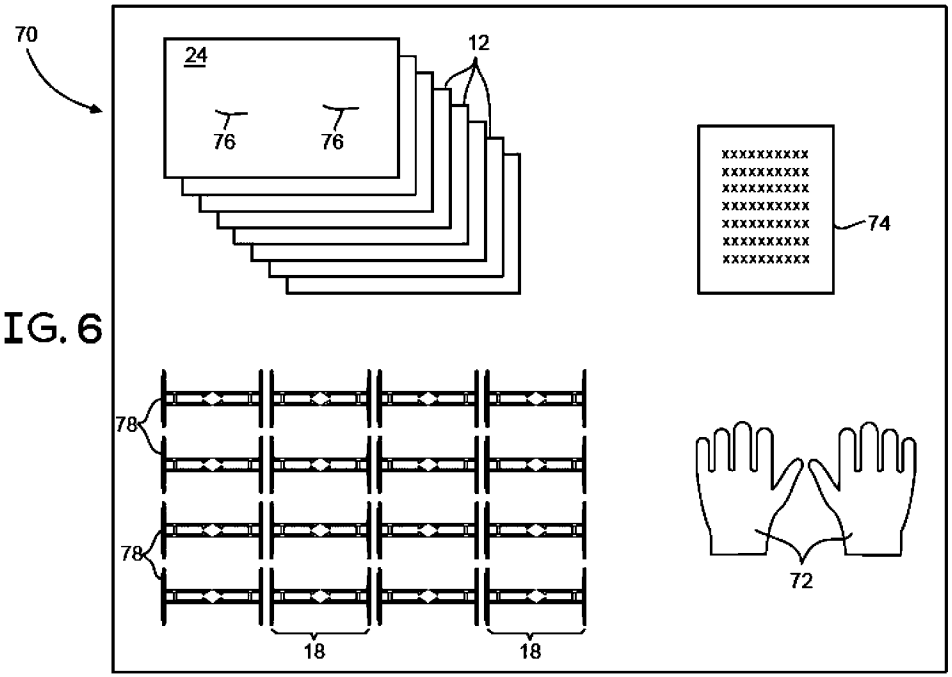
FIG. 6 is a top plan view of an installation kit of the present invention.

Reference is now made to FIG. 6 illustrating a garage door insulating kit 70 of the present invention. The kit 70 comprises a quantity of at least eight sections of insulation material 12 and a quantity of at least sixteen securing clips 18. As further illustrated, the insulating kit 70 may optionally include a pair of vinyl gloves 72 and installation instructions 74. In one possible embodiment the securing clips 18 have pre-applied adhesive 78 on at least one end. Further, it should be appreciated that the insulation material 12 may include the optional vinyl facing 24 and/or at least two pre-cut slits 76 through which the clips 18 are secured.

The foregoing description of the preferred embodiments of the present invention have been presented for purposes of illustration and description. It is not intended to be exhaustive or to limit the invention to the precise form disclosed. Obvious modifications or variations are possible in light of the above teachings.

For example, while the first and second connectors 44*a* and 44*b* of the illustrated clip 18 are identical, it should be appreciated that the connectors are not required to be identical. For example, the first and second connectors 44*a* and 44*b* may comprise cooperating male and female components if desired. Further, the connectors 44*a* and 44*b* may be secured together by snap action, friction fit, cooperating threads or any other appropriate interconnecting structure. Thus, a clip, such as that taught in U.S. Pat. No. 5,176,465 may be used. Such a clip includes cooperating male and female connectors. When the male connector is fully seated in the female connector, holes in the two connectors are aligned. A locking means, such as a pin, tab, screw or nail is then inserted in these holes to secure the two connectors of the clip together. Further, another type of clip may be used, such as snap rivets manufactured by ITW Fastex (Des Plaines, Ill.).

In the illustrated embodiment, an adhesive is utilized to affix the clip 18 and, more specifically, the first connector 44*a*, to the major exterior surface 14 of the panel 16. It should be appreciated that alternative securing means may be used including, for example, magnets, wire, screws, VELCRO, hook and loop fasteners, tape, nails or combinations thereof. Further, while the insulation layer 12 is illustrated with only a single optional facing layer 24, it should be appreciated that the insulation layer may be fully encapsulated with a facing on all sides or encapsulated on all sides except the side adjacent to the garage door 26.

The embodiments were chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when interpreted in accordance with the breadth to which they are fairly, legally and equitably entitled. The drawings and preferred embodiments do not and are not intended to limit the ordinary meaning of the claims in their fair and broad interpretation in any way.

I claim:

1. An insulation system comprising:

a panel having a major exterior surface, a layer of insulating material, and at least one securing clip affixed to said panel for securing said layer of insulating material to said major exterior surface of said panel, wherein said clip comprises a first connector and a second connector, each of said first and second connectors comprising first and second resilient latching elements; wherein each of said latching elements comprises a latching shoulder; and a locking shoulder extending completely between and connecting said first and second resilient latching elements, and wherein said first and second resilient latching elements of said first connector are configured to engage said locking shoulder of said second connector to connect said first connector to said second connector.

2. The insulation system of claim 1 wherein said panel is a garage door.

3. The insulation system of claim 1, wherein said clip is secured to said panel with adhesive.

4. The insulation system of claim 1, wherein said insulating material further comprises a first side and a second side.

5. The insulation system of claim 4, wherein said first side of the insulation material is adjacent to said major exterior surface of said panel.

6. The insulation system of claim 5, wherein said insulating material further comprises a facing on said second side.

7. The insulation system of claim 6, wherein said clip extends through said insulating material and said facing.

8. The insulation system of claim 1, wherein said first connector is identical to said second connector.

9. The insulation system of claim 1, wherein said connectors are interconnected by pushing said connectors together.

10. The insulation system of claim 1, wherein said first and second resilient latching elements of said second connector are configured to engage said locking shoulder of said first connector to connect said first connector to said second connector.

11. The insulation system of claim 1, wherein said first and second resilient latching elements of said first connector are rotated 90 degrees relative to said first and second resilient latching elements of said second connector when said first connector is connected to said second connector.

12. A clip comprising:

a first connector that comprises:

a first head;

first and second resilient spaced apart latching elements projecting from said first head;

a first latching shoulder that extends from the first resilient latching element toward the second resilient latching element, wherein the first latching shoulder is spaced apart from the first head;

a second latching shoulder that extends from the second resilient latching element toward the first resilient latching element, wherein the second latching shoulder is spaced apart from the first head; and a locking shoulder extending between and connecting said first and second resilient latching elements; and a second connector that comprises:

a second head;

first and second resilient spaced apart latching elements projecting from said second head;

a first latching shoulder that extends from the first resilient latching element toward the second resilient latching element, wherein the first latching shoulder is spaced apart from the second head;

a second latching shoulder that extends from the second resilient latching element toward the first resilient latching element, wherein the second latching shoulder is spaced apart from the second head; and a locking shoulder extending between and connecting said first and second resilient latching elements;

wherein said locking shoulder of said first connector is configured to engage said first and second latching shoulders of said second connector and said locking shoulder of said second connector is configured to engage said first and second latching shoulders of said first connector to connect said first connector to said second connector.

13. The clip of claim 12, wherein at least one of said first latching element and said second latching element of said first connector includes a pair of opposed, projecting detents adjacent a distal end of said at least one latching element.

14. The clip of claim 13, wherein said at least one latching element includes beveled sidewalls.

15. The clip of claim 14, further including a series of aligned notches in said beveled sidewalls.

16. The clip of claim 15, further including a first cam surface adjacent said latching shoulder and said distal end of said at least one latching element and a second cam surface adjacent said locking shoulder of said first connector.

17. The clip of claim 12, wherein both of said first and second resilient latching elements of said first connector include a pair of opposed, projecting detents adjacent a distal end of said latching element, beveled sidewalls, a series of aligned notches in said beveled sidewalls, and a first cam surface adjacent said latching shoulder and said distal end of said latching element.

18. The clip of claim 17, wherein said first connector is identical to said second connector.

19. The clip of claim 12, wherein said first connector comprises a second locking shoulder opposite from said locking shoulder.

20. The clip of claim 12, wherein said first connector is identical to said second connector.

21. The clip of claim 12, wherein said first and second latching elements of said first connector are identical to said first and second latching elements of said second connector.

22. The clip of claim 12, wherein said locking shoulder of said first connector is identical to said locking shoulder of said second connector.

* * * * *